United States Patent [19]

Bloom

[11] 4,174,951

[45] Nov. 20, 1979

[54] FURNACE HEATING SYSTEM

[75] Inventor: Quentin M. Bloom, Newtown, Pa.

[73] Assignee: Bickley Furnaces, Inc., Philadelphia, Pa.

[21] Appl. No.: 830,799

[22] Filed: Sep. 6, 1977

[51] Int. Cl.[2] ..... F27B 9/36

[52] U.S. Cl. ..... 432/133; 432/21; 432/26; 432/222; 431/173; 431/351; 236/15 BD; 432/144

[58] Field of Search ..... 432/222, 133, 136, 149, 432/144–146, 163, 164, 176, 179, 21, 47; 431/351, 173; 236/1 A, 1 H, 15 BD

[56] References Cited

U.S. PATENT DOCUMENTS

| | | | |
|---|---|---|---|
| 3,055,652 | 9/1962 | Remmey et al. | 432/26 |
| 3,172,647 | 3/1965 | Remmey | 432/133 |
| 3,174,735 | 3/1965 | McFadden | 431/173 |
| 3,247,884 | 4/1966 | McFadden et al. | 431/351 |
| 3,464,682 | 9/1969 | Remmey | 432/34 |
| 3,614,074 | 10/1971 | Wellford, Jr. | 432/21 |
| 3,690,626 | 9/1972 | Vernazza | 432/222 |
| 3,854,865 | 12/1974 | Fay | 432/149 |

*Primary Examiner*—Henry C. Yuen

*Attorney, Agent, or Firm*—Harding, Earley & Follmer

[57] ABSTRACT

A system for heating a furnace having a heating chamber defined by furnace walls is provided with a plurality of individual burner assemblies mounted on a furnace wall to direct heating gas streams into the heating chamber, each of the burner assemblies including a diffusion chamber, a burner arranged to direct products of combustion through the diffusion chamber into a furnace heating chamber and means for directing the flow of diffusion gases into the diffusion chamber to admix with the burner products of combustion so that the gas stream entering the furnace heating chamber has a greater mass velocity than the burner products of combustion, there being provided a diffusion gas supply means connected to the heating chamber of the furnace for delivering hot gases from the furnace heating chamber to the diffusion chambers of each of the burner assemblies.

12 Claims, 2 Drawing Figures

FURNACE HEATING SYSTEM

BACKGROUND AND SUMMARY OF THE INVENTION

This invention relates to improvements in furnace heating systems employing burner assemblies of the type shown in U.S. Pat. Nos. 3,055,652; 3,172,647; 3,174,735; 3,247,884; 3,280,769; 3,464,682; 3,744,965 and 3,843,317. The use of diffusion air in burner assemblies of the indicated type was developed by Bickley Furnaces Inc. in 1960 (see U.S. Pat. No. 3,055,652). By this arrangement, known as jet firing, the burner assembly can provide controlled jet velocities exceeding five hundred miles per hour. This high jet velocity plus close control of jet temperature assures fast, safe, uniform heating in the furnace. The high jet velocity and close temperature control are obtained by injecting secondary diffusion air into the fully burned combustion mixture in a combustion and mixing chamber, the result of which is a high velocity jet of super-heated gases. All combustion takes place in the combustion and mixing chamber and no flame enters the furnace. Furnaces equipped with this type of burner assembly can be automatically controlled at any temperature between 160° F. and 3272° F. (71° C. to 1800° C.).

The above-described burner arrangement has many resultant advantages in industry wherein the firing process is enhanced by shorter firing times, significantly improved temperature uniformity, and reduced fuel consumption.

With the above-described systems, cold (room temperature) diffusion air is introduced into the burner assembly resulting in a dropping of the temperature of the gases entering the furnace chamber because the cold air is mixed with the hot burned gases from the burners. A good deal of heat is consumed by heating up the cold air to whatever temperature is delivered to the furnace heating chamber. Even though there is an inherent fuel usage with cold diffusion air, in the above-described systems, there has been produced a reduction in the fuel usage per pound of work heated as compared with prior systems because of the improvements in the heat transfer mechanism in the furnace.

In accordance with the heating system of the present invention, it is possible to obtain all the advantages of improved heat transfer in the furnace while, at the same time, reducing the amount of heat consumed by the heating system. In accordance with the furnace heating system of the invention, the diffusion air for the burner assembly of the indicated type is taken from the flue of the furnace and is, therefore, at an elevated temperature so that the amount of heat that goes into raising the diffusion air to the desired heating gas temperature is reduced. In other words, the heating system of the invention involves taking spent gases in the furnace (which are taken from the furnace flue) through a blower and delivering such gases back into the burner tunnel. Thus, diffusion gases at an elevated temperature are being mixed with the products of combustion from the burner. When hot gases are delivered to the burner assembly, in order to get the same heating effect in the furnace as with a cold diffusion air system, it is necessary to reduce the firing rate of the burners. Thus, by using hot diffusion gases, a substantial amount of heat is taken off the combustion system to thereby produce considerable fuel savings.

Briefly stated, the above-described general object of the invention is achieved by the provision of a system for heating a furnace having a heating chamber defined by furnace walls is provided with a plurality of individual burner assemblies mounted on a furnace wall to direct heating gas streams into the heating chamber, each of the burner assemblies including a diffusion chamber, a burner arranged to direct products of combustion through the diffusion chamber into a furnace heating chamber and means for directing the flow of diffusion gases into the diffusion chamber to admix with the burner products of combustion so that the gas stream entering the furnace heating chamber has a greater mass velocity than the burner products of combustion, there being provided a diffusion gas supply means connected to the heating chamber of the furnace for delivering hot gases from the furnace heating chamber to the diffusion chambers of each of the burner assemblies.

DETAILED DESCRIPTION OF THE PREFERRED EMBODIMENT OF THE INVENTION

Figure 1:
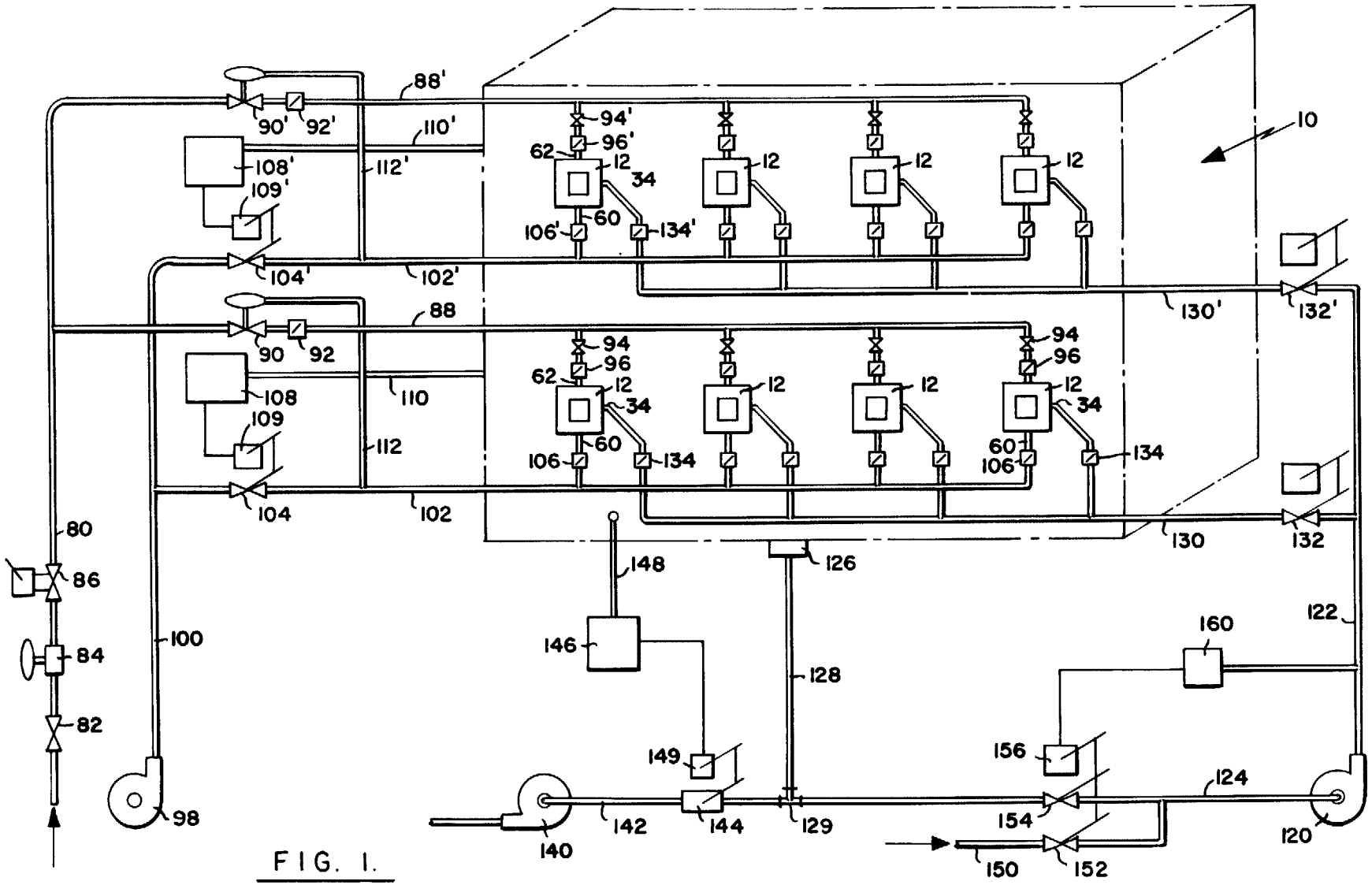
FIG. 1 is a diagrammatic illustration of the furnace heating system in accordance with the invention.

While the present invention as described below relates to gas-air burners, it is to be noted that the same general principles will apply to distillate oil fuel burners which would require means for atomizing the fuel oil prior to its mixture with the combustion air. Also, the heating system of the invention is applicable to various types of furnaces, such as kilns, ovens, lehrs and metallurgical furnaces.

Referring to the drawings, a furnace is generally indicated at 10 and is shown diagrammatically as being a two-zone furnace. The furnace 10 has a heating chamber 11 and eight burner assemblies 12 mounted in the furnace side wall 13, the burner assemblies 12 being arranged in a lower zone and an upper zone as is apparent from a consideration of FIG. 1.

Figure 2:
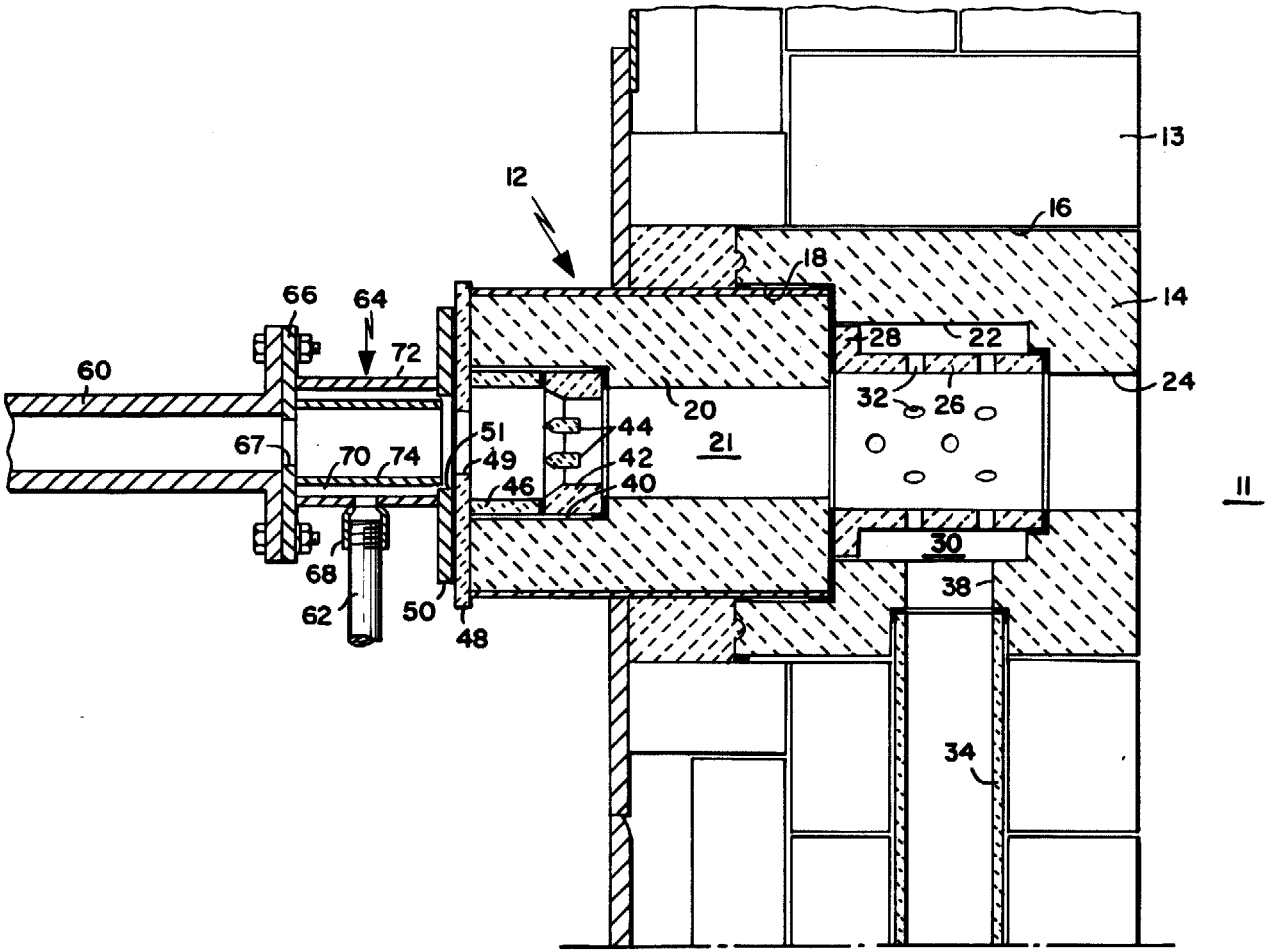
FIG. 2 is a sectional view of a burner assembly incorporated in the wall of the furnace provided with the heating system of FIG. 1.

A burner assembly 12 is shown in detail in FIG. 2 and comprises a rectangular block 14 mounted in a rectangular opening 16 in the refractory blocks that make up the furnace wall 13. Block 14 has a recess 18 in the outer end thereof adapted to receive the downstream end of a burner block 20 which extends to the exterior of the furnace and defines a combustion chamber 21 therein. Block 14 is provided with a cavity 22 in a medial portion thereof and a bore 24 at the downstream end thereof. The cavity 22 provides communication between the recess 18 and the end bore 24. A cylindrical diffuser member 26 is mounted in central cavity 22 and defines at the inner wall thereof a passageway between chamber 21 and bore 24. The inner wall of diffuser member 26, the combustion chamber 21 and the bore 24 are all in axial alignment. Diffuser member 26 has a radially extending flange 28 which positions the diffuser member 26 within cavity 22 so that the diffuser member outer wall is spaced from the wall of the cavity 22 to define an annular chamber 30 therebetween. Diffuser member 26 has a plurality of radial openings 32 extending therethrough and circumferentially and longitudinally spaced thereabout. Openings 32 serve to meter or control the amount of gas passing from chamber 30 through the diffuser member 26 into the products of combustion passing from the burner as will be described hereafter.

A ceramic conduit 34 is mounted in the side wall 13 of the furnace to extend from a coupling member (not shown) to a passage 38 in the block 14, passageway 38 communicating with the annular chamber 30. Conduit 34 and passageway 38 provide a path for the flow of diffusion gases to the burner assembly 12 for mixture with the burner products of combustion within the diffuser member 26.

Burner block 20 has a recess 40 in the upstream end thereof. Mounted in the recess 40 adjacent the chamber 21 is a centering ring 42 having a pair of flame holder bars 44 extending in parallel relation transversely thereacross. A tube 46 is mounted in recess 40 adjacent ring 42 and upstream thereof. The outer end of the burner block 20 is enclosed by an insulation plate 48 which has a burner mounting bracket 50 secured thereto by suitable mounting bolts (not shown). Insulation plate 48 and mounting plate 50 are provided with central openings 49 and 51, respectively, aligned with the axis of the burner block 20 as is apparent from FIG. 2.

A burner nozzle assembly is mounted to extend from the mounting plate 50 to communicate with the central opening 51 therein. The burner nozzle assembly comprises an air pipe 60 and a gas pipe 62 secured at their downstream end onto a mounting assembly 64. The mounting assembly 64 is mounted on the mounting bracket 50 and the air pipe 60 is secured at its downstream end onto a bracket portion 66 of mounting assembly 64 and communicates with a central opening 67 in the mounting bracket 66.

The gas pipe 62 has its downstream end threaded for engagement with a suitable threaded fitting 68 on the mounting assembly 64. The fitting 68 communicates with an annular chamber 70 defined between the interior of two tubular portions 72 and 74 of the mounting assembly 64.

By this arrangement, the combustion air flows from tube 60 through central opening 67 into the interior of the inner tube 74 and through the openings 51 and 49 in plates 50 and 48, respectively, into the interior of the tube 46 within the burner block 20. The combustion gas flows through tube 62, fitting 68 into the annular chamber 70 from which the gas flows through the central openings 51 and 49 in plates 50 and 48, respectively, for admixture with the combustion air within the tube 46 in burner block 20.

In the operation of the burner, combustion air supplied to pipe 60 and fuel gas supplied to pipe 62 mix together as they flow into the burner proper through the openings 51 and 49 in plates 50 and 48, respectively. The mixed gases then flow into the restricted orifice provided by the centering ring 42 and the bars 44 which serve to accelerate and assist the mixing action. The burner is provided with the usual pilot connection (not shown) for ignition of the fuel-air mixture within the combustion chamber 21. As is described more fully in U.S. Pat. No. 3,247,884, the flame proper will occupy the combustion chamber 21 and the combustion reaction and flame are completed before the gases exit from the combustion chamber 21, the flame front starting in the vicinity of the bars 44.

The products of combustion leave combustion chamber 21 and pass into the central chamber of the diffuser member 26. Diffusion gas passes from conduit 34 through passageway 38 into annular chamber 30 from which the diffusion gas passes through openings 32 which serve to meter the diffusion gas and cause it to mix in small jets with the fully burned combustion products passing from the combustion chamber 21. The diffuser member 26 insures that there is a thorough mixture or diffusion of the diffusion gas and the products of combustion by reason of the plurality of openings 32 which direct the small jets of air into the products of combustion. The heating gas stream passes from passage 24 into the furnace heating chamber 11.

Referring to FIG. 1, the fuel gas is supplied through the line 80 which is provided with a shutoff valve 82, a pressure regulator 84 and an automatic shutoff valve 86 as is conventional. The fuel gas is supplied to the burner assemblies 12 for the lower zone through a line 88 provided with a pressure regulator 90 and a limiting orifice valve 92. At each burner assembly 12, the supply line 88 is connected to the gas pipe 62 through a shutoff valve 94 and a limiting orifice valve 96.

The combustion air is supplied by a combustion air blower 98 through a line 100. The combustion air is supplied to the burner assemblies 12 for the lower zone through a line 102 containing a temperature control valve 104. At each burner assembly 12, the supply line 102 is connected to the air pipe 60 through a limiting orifice valve 106.

The limiting orifice valves 94 and 106 for controlling the fuel gas and combustion air supply to the burners are constructed and arranged so that by adjustment of these two limiting orifice valves, taking into account the pressures that are normally existent in the supply lines at their locations, the flows of the combustion air and the fuel gas can be balanced.

There is also provided automatic temperature control means which changes the burning rate of the burners as the temperature varies within the furnace or the load varies within the furnace to maintain a desired temperature within the furnace heating chamber 11. Such means comprises a temperature controller 108 which is operatively connected to an actuator 109 for the valve 104 and is provided with a connection 110 for sensing the temperature within the heating chamber 11 of the furnace. The temperature controller 108 is set for a predetermined temperature and will maintain this temperature by positioning the valve 104 to regulate the amount of combustion air that is supplied to the burner assemblies 12 to meet the heating demand. Downstream of the valve 104, a small tubing 112 runs from the line 102 to the pressure regulator valve 90. This arrangement serves to apply the pressure at the line 102 downstream of the valve 104 to the pressure regulator 90 which operates to adjust the valve 90 to maintain the same pressure in the line 88 immediately downstream of the valve 90. Thus, the pressure out of the regulator 90 is always the same as the air input pressure in line 102. As the pressure in line 102 varies, the regulator 90 is operative to vary the gas pressure to match the air inlet pressure to thereby keep the fuel gas flow and the combustion air flow balanced.

Since the pressures of the fuel gas and combustion air generally need not be the same at the burner assemblies 12, and in fact burners are usually designed for a slight difference in pressure, the limiting orifice valve 92 is adjusted to provide the appropriate pressure drop through this valve to provide the desired gas pressure in the line 88. Once the limiting orifice valve 92 is set, this determines the gas-air ratio for the entire lower zone since this adjustment determines the pressure in line 88 in relation to line 102.

Means are provided for supplying diffusion gas to the supply tube 34 of each of the burner assemblies 12. Such means comprises a recirculating blower 120 having its delivery end connected to a line 122 and its intake end connected to a line 124. The line 124 is connected to the furnace flue 126, which is located at the bottom of the furnace 10, by a line 128 which joins line 124 at a tee 129. The diffusion gas is supplied to the burner assemblies 12 for the lower zone by a line 130 provided with a regulator valve 132 for controlling flow therethrough. At each burner assembly 12, the supply line 130 is connected to the diffusion gas supply tube 34 through a limiting orifice valve 134.

The various gases, i.e., combustion products and diffusion gases, that are added to the heating chamber 11 of the furnace 10 build up volume inside the furnace. Accordingly, it is necessary to vent an equivalent volume of gases from the furnace chamber 11. To this end, control means are provided for exhausting a controlled amount of flue gases, such control means being responsive to the pressure in the furnace heating chamber 11 and connected to the flue gas supply line 124 to the blower 120. The control means includes an exhaust blower 140 having its delivery end connected to an exhaust stack and its intake end connected to line 128 at the pipe tee 129 by a line 142. The line 142 has a regulator damper 144 connected therein. The damper 144 is controlled by a furnace pressure controller 146 which is responsive to the pressure within the furnace heating chamber by a connection 148, and actuates the damper 144 by means of an actuator 149. The controller 146 is set to operate the damper 144 to control the flue exhaust gas passing from the flue 128 through the line 142 to the exhaust blower 140 so that a predetermined pressure is maintained in the furnace heating chamber. The gases that are not exhausted through the line 142 flow through the line 124 to the intake of the recirculating blower 120.

A diffusion gas temperature control means is provided for controlling the mixture of room air with the diffusion gas supplied to the recirculating blower 120 through the line 124. Such means serves to cool the gases introduced into the furnace chamber by lowering the temperature of the diffusion gases that are delivered to the burner assemblies 12. This control means comprises a supply line 150 for delivering room temperature air to the line 124 and a pair of valves 152 and 154 linked together and operated by an actuator 156 under the control of a diffusion gas temperature controller 160. Valve 152 is connected in the line 150 to control the flow of room air through line 150 to the line 124. Valve 154 is connected in the line 124 to control the flow of flue gases therethrough. The linked together valves 152 and 154 are constructed so that when they are moved together by the actuator 156, valve 152 increases the flow of room air through line 150 while at the same time valve 154 decreases the flow of flue gases through line 124 and vise versa. The controller 160 is connected to the line 122 to sense the temperature therein and is set to maintain a predetermined temperature in the line 122.

By the above-described arrangement, the cooling rate of the burner assemblies 12 can be controlled by drawing cold air through line 150 and mixing it with the hot flue gases passing through line 124. The burning rate of the burner assemblies 12 will be reduced as the gases delivered into the diffusion chambers thereof will have a lower temperature. This is all achieved under the control of the diffusion air temperature controller 160 which is set to achieve the desired amount of cooling. Ultimately, the valve 154 can be fully closed and the valve 152 can be fully opened, in which case only room temperature air is delivered to the burner assemblies 12 to achieve the maximum amount of cooling.

The burner assemblies 12 for the upper zone are supplied with fuel gas from line 80, combustion air from line 100 and diffusion gas from line 122 by means substantially the same as the means provided for the burner assemblies 12 of the lower zone as described above. Accordingly, corresponding parts have been designated by the same reference numerals with primes added. Fuel gas is supplied to the burner assemblies 12 for the upper zone through a line 88' provided with a pressure regulator 90' and a limiting orifice valve 92'. At each burner assembly 12, the supply line 88' is connected to the gas pipe 62 through a shutoff valve 94' and a limiting orifice valve 96'.

The combustion air is supplied to the burner assemblies 12 for the upper zone through a line 102' containing a temperature control valve 104'. At each burner assembly 12, the supply line 102' is connected to the air pipe 60 through a limiting orifice valve 106'. The limiting orifice valves 94' and 106' are adjusted to balance the flows of the combustion air and the fuel gas.

An automatic temperature control means for the burner assemblies 12 of the upper zone comprises a temperature controller 108' operatively connected to the valve 104' by actuator 109' and provided with a connection 110' for sensing the temperature within the heating chamber 11 of the furnace. Downstream of the valve 104', a small tubing 112' runs from line 102' to the pressure regulator valve 90', this arrangement serving to maintain the same pressure in line 108' immediately downstream of valve 90' as is in line 102'.

The diffusion gas is supplied to the burner assemblies 12 for the upper zone by a line 130' provided with a regulator valve 132' for controlling flow therethrough. At each burner assembly 12, the supply line 130' is connected to the diffusion gas supply tube 34 through a limiting orifice valve 134'.

It is to be noted that the burner design of the burner assembly 12 is such that combustion has taken place prior to the introduction of the diffusion gases. Accordingly, this permits the introduction of almost any type of gas in the form of the diffusion gas since the gas is not used in any manner for combustion and therefore does not require any particular oxygen content. Accordingly, the flue gases can be used as the combustion gas without in any way reducing the efficiency of the burner. These flue gases normally would not contain any appreciable amount of oxygen and are actually spent gases.

A feature of the invention not mentioned heretofore is that it is possible to go to higher recirculating gas temperatures than with other comparable burning systems such as those using an excess air combustion system. Excess air systems have been used, for example, in the heating of steels to high temperatures such as above 1600° F. At these high temperature levels, the steel oxidizes to produce scale and there is a considerable amount of metal lost from the surface of the steel. By reason of the recirculating system of the invention, it is possible to recirculate gases that should not contain any appreciable amount of oxygen. This is achieved by setting the controller 160 to keep the valve 152 closed.

With this set up, the only oxygen that would be in the recirculating gases would be those resulting from inherent leakage that there is in every furnace. Thus, the heating system of the invention enables the user to go to higher recirculating gas temperatures than with the prior so-called excess air combustion systems used in the art.

I claim:

1. A system for heating a furnace having a heating chamber defined by a furnace wall comprising:

a plurality of individual burner assemblies mounted on the furnace wall to direct heating gas streams into the heating chamber, each of said burner assemblies having means defining a diffusion chamber, a burner means arranged to direct its products of combustion through said diffusion chamber into the furnace heating chamber, and means for directing the flow of diffusion gas into said diffusion chamber to admix with said burner products of combustion so that the gas stream entering the furnace heating chamber has a greater mass velocity than the burner products of combustion, means for supplying diffusion gas to said diffusion gas directing means of each of said burner assemblies, said diffusion gas supply means being connected to the heating chamber of said furnace at a location to withdraw hot products of combustion gases from said furnace heating chamber and being connected to each of said burner assemblies for delivering said hot products of combustion gases thereto, said burner means of each of said burner assemblies being adapted to burn a mixture of fuel gas and air, means for supplying fuel gas through a supply line to each of said burner assemblies, and means for supplying combustion air through a supply line to each of said burner assemblies, each of said burner assemblies having means for balancing the flow of fuel gas and the flow of combustion air to said burner means thereof.

2. A furnace heating system according to claim 1 including means responsive to the temperature of the gases in said furnace heating chamber for controlling the flow of fuel gas and combustion air through said supply lines therefor to maintain a desired burning rate of said burner means and for balancing said flow.

3. A furnace heating system according to claim 1 wherein the furnace is provided with a flue and said diffusion gas supply means includes a first diffusion gas supply line connected to each of said burner assemblies at said diffusion gas directing means thereof, a recirculating blower having its delivery end connected to said first diffusion gas supply line for delivering diffusion gas thereto, and a second diffusion gas supply line connected between the flue of the furnace and the intake end of said blower.

4. A system for heating a furnace having a heating chamber defined by a furnace wall comprising:

a plurality of individual burner assemblies mounted on the furnace wall to direct heating gas streams into the heating chamber, each of said burner assemblies having means defining a diffusion chamber, a burner means arranged to direct its products of combustion through said diffusion chamber into the furnace heating chamber, and means for directing the flow of diffusion gas into said diffusion chamber to admix with said burner products of combustion so that the gas stream entering the furnace heating chamber has a greater mass velocity than the burner products of combustion, means for supplying diffusion gas to said diffusion gas directing means of each of said burner assemblies, said diffusion gas supply means being connected to the heating chamber of said furnace at a location to withdraw hot products of combustion gases from said furnace heating chamber and being connected to each of said burner assemblies for delivering said hot products of combustion gases thereto, said furnace being provided with a flue, said diffusion gas supply means including a first diffusion gas supply line connected to each of said burner assemblies at said diffusion gas directing means thereof, a recirculating blower having its delivery end connected to said first diffusion gas supply line for delivering diffusion gas thereto, and a second diffusion gas supply line connected between the flue of the furnace and the intake end of said blower, and control means responsive to the pressure in said furnace heating chamber and connected to said second diffusion gas supply line for exhausting a controlled amount of said flue gases.

5. A furnace heating system according to claim 4 wherein said last-named control means includes an exhaust blower and a damper located in a line connected to said second diffusion gas supply line.

6. A system for heating a furnace having a heating chamber defined by a furnace wall comprising:

a plurality of individual burner assemblies mounted on the furnace wall to direct heating has streams into the heating chamber, each of said burner assemblies having means defining a diffusion chamber, a burner means arranged to direct its products of combustion through said diffusion chamber into the furnace heating chamber, and means for directing the flow of diffusion gas into said diffusion chamber to admix with said burner products of combustion so that the gas stream entering the furnace heating chamber has a greater mass velocity than the burner products of combustion, means for supplying diffusion gas to said diffusion gas directing means of each of said burner assemblies, said diffusion gas supply means being connected to the heating chamber of said furnace at a location to withdraw hot products of combustion gases from said furnace heating chamber and being connected to each of said burner assemblies for delivering said hot products of combustion gases thereto, said furnace being provided with a flue, said diffusion gas supply means including a first diffusion gas supply line connected to each of said burner assemblies at said diffusion gas directing means thereof, a recirculating blower having its delivery end connected to said first diffusion gas supply line for delivering diffusion gas thereto, and a second diffusion gas supply line connected between the flue of the furnace and the intake end of said blower, and diffusion gas temperature control means for controlling the mixture of room air with the diffusion gas supplied to said recirculating blower through said second diffusion gas supply line.

7. A furnace heating system according to claim 6 wherein said diffusion gas temperature control means includes a first valve means for controlling the flow of flue gases through said second diffusion gas supply to said recirculating blower, a second valve means for controlling the flow of room air to said second diffusion gas supply line, and a controller for controlling the first and second valve means to control the amount of room air mixed with said flue gases.

8. A furnace heating system according to claim 7 wherein said diffusion gas temperature control means includes means responsive to the temperature of gases delivered through said first diffusion gas supply line.

9. A furnace heating system according to claim 8 including control means responsive to the pressure in said furnace heating chamber and connected to said second diffusion gas supply line for exhausting a controlled amount of said flue gases.

10. A furnace heating system according to claim 9 wherein said burner means of each of said burner assemblies is adapted to burn a mixture of fuel gas and air, and including means for supplying fuel gas through a supply line to each of said burner assemblies, and means for supplying combustion air through a supply line to each of said burner assemblies, each of said burner assemblies having means for balancing the flow of fuel gas and the flow of combustion air to said burner means thereof.

11. A furnace heating system according to claim 10 including means responsive to the temperature of the gases in said furnace heating chamber for controlling the flow of fuel gas and combustion air through said supply lines therefor to maintain a desired burning rate of said burner means and for balancing said flow.

12. A furnace heating system according to claim 11 wherein said control means for exhausting a controlled amount of flue gases includes an exhaust blower and a damper located in a line connected to said second diffusion gas supply line.

* * * * *